US005568767A

United States Patent [19]

Jackson

[11] Patent Number: 5,568,767

[45] Date of Patent: Oct. 29, 1996

[54] METHOD AND DEVICE FOR MAINTAINING PRINT TO CUT REGISTER

[75] Inventor: Dale H. Jackson, Newmarket, N.H.

[73] Assignees: Heidelberger Druckmaschinen AG, Heidelberg, Germany; Heidelberg Harris, Inc., Dover, N.H.

[21] Appl. No.: 430,511

[22] Filed: Apr. 27, 1995

[51] Int. Cl.[6] ..... B41F 13/56

[52] U.S. Cl. ..... 101/226; 101/248; 101/486; 226/4; 226/45; 364/469.01; 83/365; 83/367

[58] Field of Search ..... 101/225, 226, 101/224, 227, 248, 486; 226/4, 15, 28, 29, 30, 31, 38, 45; 364/469; 83/74, 365, 367, 371

[56] References Cited

U.S. PATENT DOCUMENTS

| | | | |
|---|---|---|---|
| 2,863,387 | 12/1958 | Huffman . | |
| 3,152,542 | 10/1964 | Chambon . | |
| 3,608,799 | 9/1971 | Edson | 226/30 |
| 4,214,524 | 7/1980 | Corse | 226/28 |
| 4,264,957 | 4/1981 | Pautzke | 364/469 |
| 4,318,176 | 3/1982 | Stratton et al. | 364/469 |
| 4,361,260 | 11/1982 | Hanlan | 61/248 |
| 4,528,630 | 7/1985 | Sargent | 364/469 |
| 4,541,335 | 9/1985 | Tokuno et al. | 101/248 |
| 4,552,608 | 11/1985 | Hoffmann et al. | 226/30 |
| 4,781,317 | 11/1988 | Ditto . | |
| 4,847,775 | 7/1989 | Roch et al. . | |
| 4,896,605 | 1/1990 | Schröder | 101/486 |
| 4,955,265 | 9/1990 | Nakagawa et al. | 83/371 |
| 4,991,761 | 2/1991 | Gnuechtel et al. . | |
| 5,016,182 | 5/1991 | Bergland et al. | 364/469 |

*Primary Examiner*—Eugene H. Eickholt
*Attorney, Agent, or Firm*—Kenyon & Kenyon

[57] ABSTRACT

A scanner senses the position of the individual images on the web. A cutting cylinder position is monitored by a signal generator, and may be altered by mechanically changing the phase of the cutting cylinders in relation to the image on the web based on commands relating to the image registration error, the first derivative of the image registration error and/or the second derivative of the image registration error.

12 Claims, 2 Drawing Sheets

METHOD AND DEVICE FOR MAINTAINING PRINT TO CUT REGISTER

FIELD OF THE INVENTION

The invention relates generally to folders for a continuous web and more particularly to a method and device for maintaining the print to cut register in the folder of a printing press.

BACKGROUND OF THE INVENTION

The folder of a web printing press cuts and arranges signatures which are printed on a continuous web of material, such as paper. However, the cutting device of the folder often may fall into misalignment with the image on the web, cutting the web at the improper time. The image on the resulting signatures will be lengthwise off-center, or even partially cut off, often creating a large amount of unusable or poor quality signatures. It is therefore important to cut the web at a proper place, i.e. to keep the images on the web in register with the cutting device of the folder.

Methods and devices for maintaining the proper print to cut register are known. One such device is the Microtrak 9500 sold by Web Printing Controls, Inc. Its method of operation involves having a cutter cut the web at constant intervals, and altering the web position with a conventional web compensator to maintain register. A web scanner senses the position of the image as it enters the folder. The cutter position is monitored by a reference generator. If the position of the image is out of register with the cutter position, the web is moved forward or backward by the web compensator by the desired amount to restore register. The web compensator motor therefore "clicks" the web compensator up or down a set amount to move the web forward or backward. As stated in the manual of this device, compensation of this device also occasionally may be maintained by the cutter by leaving the scanner input constant and mechanically changing the cutter's phase in relation to the print.

The above-mentioned device and method has the drawback that the scanner is located far from the cutter and all disturbances which occur in machinery between the scanner and the cutter are ignored. Typically, 50 to 100 feet of web may run between the scanner and the cutter.

Moreover, the response time of the above-mentioned device is often insufficient to eliminate print to cut registration defects in faster presses.

SUMMARY OF THE INVENTION

The present invention therefore provides a method for correcting the register of images on a running web with a web processing device of the machine comprising the steps of measuring a position of each image on the web; generating a reference signal corresponding to a desired position of each image on the web; creating a position error data stream corresponding to an image registration position error between the measured image positions and the reference signals; and continuously sending control commands to the web processing device based on at least the position error data stream.

The web processing device may also be fed a speed command data stream derived from the slope or derivative of the position error data stream. This method improves the response time of the web processing device to the registration errors in the press or folder.

Moreover, the first derivative or impulses of the speed command data stream may be used to provide armature current torque commands to the web processing device. By providing position, speed and torque commands to the controller of the web processing device, very accurate correction of the errors measured by the scanner can be provided, especially correction of lower frequency errors. The response time of the system is greatly increased.

The position error data preferably may be arranged into sample sets whose size corresponds to the minimum response interval of the web processing device. For example, if a cutting cylinder has a minimum response time of 300 ms, the press is running at 3000 ft/min and the impression size is 20 inches, the data would be grouped in sets of nine, since the web would move 180 inches every 300 ms. At a press speed of 2000 ft/min, the sample set would be six impressions or forms. By using sample set which correspond to the minimum response interval of the web processing device, the distance between the cutting cylinder and scanner may be kept to a minimum, as will be described later.

From the position error data of the sample set, the speed and torque commands are calculated by a microprocessor for that set. The three data streams, i.e. position error, speed, and torque commands, are then sent to a drive control motor to control the web processing device.

There are a number of forms or impressions in each sample set. It is desirable that the web processing device act on the forms of a sample set based on commands derived from those same forms. Ideally, then, the calculations for the commands will be completed and the commands issued to the web processing device just as the first form of the sample set enters the web processing device. However, this requires a distance between the scanner and the web processing device greater than the sample set, so as to permit sufficient time for the web processing device to respond to the sample set data. By creating a sample set size corresponding to the minimum response time of the web processing device, the distance between the scanner and the web processing device can be kept to a minimum while still providing a sufficient amount of data. This reduces many of the distortions of previous devices, where the distance between the scanner and the web processing device was much greater.

It is possible that the geometry of a press may not always permit the desired distance between the scanner and the web processing device, and therefore the scanner must be located closer to the web processing device than the web length corresponding to the maximum sample set size. The forms of a sample set then may already begin to move through the web processing device before the web processing device has an opportunity to receive commands based on that sample set. For example, two forms of a five form sample set may already have passed through the web processing device before the calculations for that sample set are completed. According to this embodiment of the invention, it is then possible to use statistical trending from the previous sample set to provide more accurate commands to process the forms of the current sample set.

The web processing device may be a cutting cylinder of a folder.

The present invention also provides a folder for a web comprising a scanner for monitoring images on the web, a cutting or web processing device for cutting the web into signatures or processing the web, a drive motor connected to the cutting device for constantly correcting register, an encoder connected to the cutting or processing device for generating a synchronization signal, and a microprocessor for receiving inputs from the scanner and the encoder and for sending constant signals to the drive motor.

The folder therefore allows for elimination of the use of a conventional web compensator by using the drive motor to constantly correct the print to cut registration defects. By eliminating the web compensator, the compensation is achieved solely downstream of the scanner, allowing for quicker and more accurate response times. Preferably, the scanner and the cutting device are located a distance apart which is just greater than the maximum web speed multiplied by the minimum response time of the cutting device. This minimizes distortions which arise between the scanner and processing device while still providing time for sending commands based on the sample set data to the processing device. For instance, the scanner and the cutting device may be located one or two standard image lengths further apart than the distance corresponding to the maximum web speed multiplied by the minimum response time of the cutting device.

In another embodiment the scanner may be placed much closer to the cutting device. The web length between the scanner and the cutting device can then be much less, even fewer than four or five image lengths away.

The drive motor controller also has a regulating capability for the shaft position, speed and armature current or torque. This allows for extremely precise control of the cutting device, as mentioned with regard to the method described above.

BRIEF DESCRIPTION OF THE DRAWINGS

The present invention may be better understood with reference to the drawings, in which.

DETAILED DESCRIPTION

Figure 1:
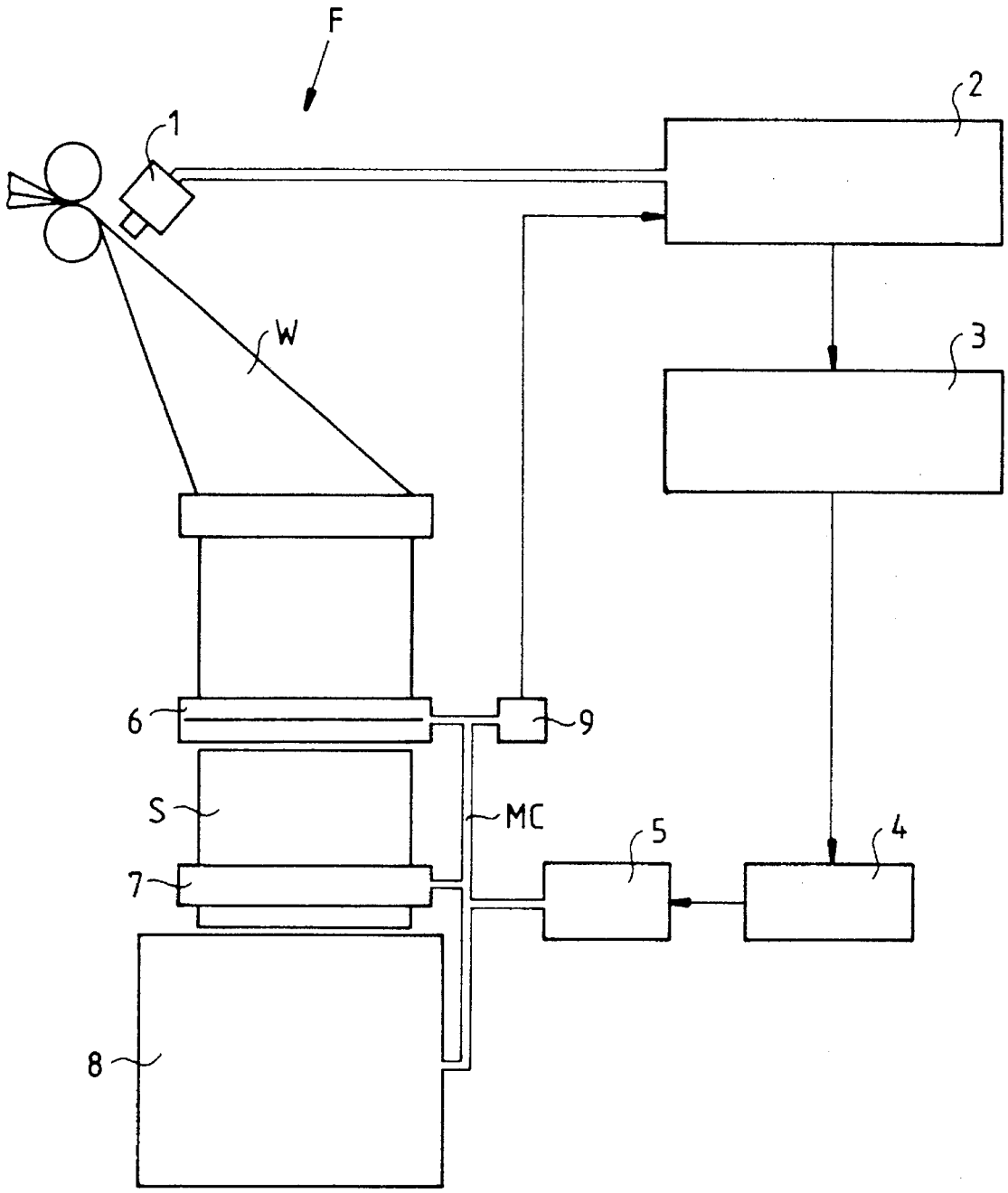
FIG. 1 is a schematic view of the folder of the present invention.

FIG. 1 shows a folder F through which a web W passes. A cutting cylinder 6 of the folder F cuts the web W to create individual signatures S, which pass through delivery rolls 7 into a fan or fans 8 in a known manner, such as described by U.S. Pat. No. 5,112,033 issued May 12, 1992, which is hereby incorporated by reference. A scanner 1 of the folder F measures the relative position of the printed images on the web W. An encoder 9 is connected to a cutting cylinder 9 and provides synchronizing information. A scanner controller 2 measures any registration errors between the scanner information and the synchronizing information and feeds this information to a control computer or microprocessor 3. The control computer 3 utilizes a sampling and predictive technique, which will be described below, to construct control commands which are sent to a machine drive motor controller 4. These commands include a position regulation data stream (i.e., a registration error data stream), a speed command data stream and a torque command data stream. The drive motor controller 4 adjusts the phase of a drive motor 5 according to this data. Mechanical couplings MC then adjust the phase of the cutting cylinder 6, the encoder 9, the delivery rolls 7, and the fan 8 of the folder F.

The computer 3 calculates the position regulation data stream, the speed command data stream and the torque command data stream as follows. The control computer receives the registration error of the image position on an every impression basis and logs this data along with the time of occurrence of each.

The data are arranged into sample sets whose size corresponds to the minimum response interval of the cutting cylinder electromechanical system, i.e. the time it takes to calculate the data streams from the sample set, transfer it to the drive motor 5 and begin changing the cutting cylinder 6 phase. For example, for a current high speed press such as the Heidelberg Harris M-3000 Sunday Press, if the cutting cylinder minimum response time is 300 ms, the data would be grouped in sets of nine when the press runs at a speed of 3000 ft/min and the impression length is 20 inches. This is because that press would deliver nine impressions or forms every 300 ms. At two thirds speed the data sets would consist of six measurements. At 45% rated speed, the data sets would consist of four measurements.

The sample set data is then applied to the cutting cylinder 6 via drive motor 5 to cut the forms of the sample set. Ideally, the scanner 1 is placed far enough away from the cutting cylinder 6 to allow the forms of the sample set to be cut based on data from that exact sample set. For example, if the largest possible sample set, based on maximum web speed and cutting cylinder response time as described above, is nine 20 inch forms, the scanner 1 should be further than 180 inches from the cutting device 6.

However, if the press geometry does not allow for placement this far apart, the scanner 1 may be located closer to the cutting cylinder 6, even on the order of one or two feet. The forms of the sample set going past the cutting cylinder are then cut based on data from a previous sample set, preferably the sample set taken from the web just forward of the forms going through the cutting cylinder 6. Because the sample set sizes correspond to the minimum response interval of the cutting cylinder electromechanical system as described above, there is always enough time to apply the previous sample set data to the beginning of the web corresponding to the following sample set. To improve performance when the sample set is cut based on previous data, the microprocessor can determine a statistical trend from the previous sample set data and apply the trended data to process the current sample set. The exact timing of the application of the cutting cylinder to the web is easily controlled by the microprocessor based on web speed, the known distance between the scanner 1 and the cutting cylinder 6, and the actual response interval of the cutting cylinder.

Figure 3:
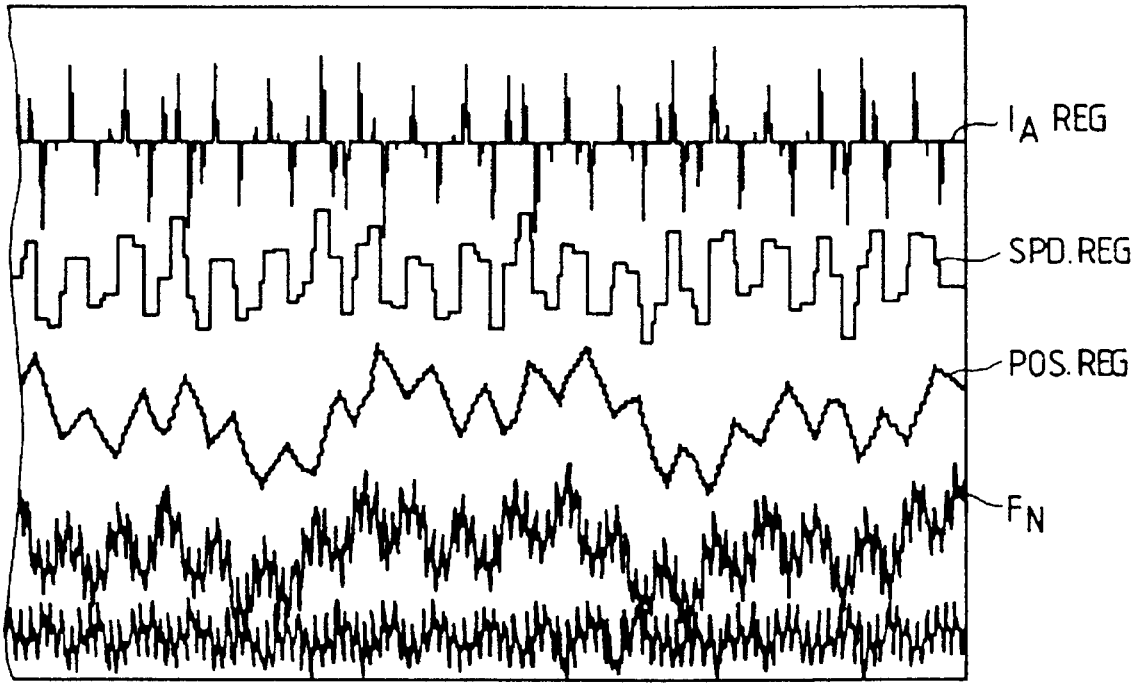
FIG. 3 shows various simulated data streams supplied to the web processing device controller.

Each sample set provides an image registration error data set, which corresponds to position command data which will be sent to the drive motor 5 so that drive motor 5 changes its position in response to the position command data, as shown in FIG. 3 by the line identified as POS. REG. The derivative of the registration error data set (i.e. a data set corresponding to the measured difference between the registration error data points) creates a speed command data set, as shown in FIG. 3 by the line identified as SPD. REG. This speed command data stream is used as a constant speed command to the drive motor 5 which changes its speed during the response interval and causes the knives to change phase at a constant rate in a direction to reduce cutoff error. The impulses or first derivative of the speed step commands, in other words the second derivative of the position command data stream, form a torque command data set, which become armature current torque commands. This torque command data stream is identified in FIG. 3 by line $I_A$ REG.

The drive motor controller 4 therefore has regulating capability for the shaft position, speed and armature current or torque. The use of the speed and armature torque commands results in a much faster response time so that the drive motor shaft obtains its the desired position almost instantaneously.

Figure 2:
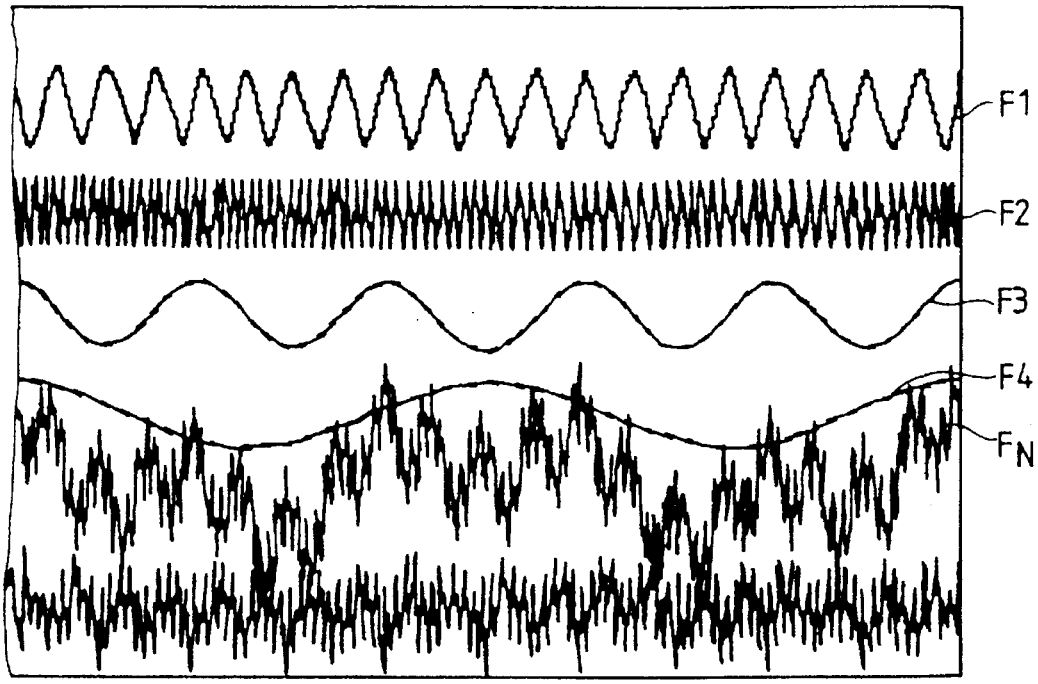
FIG. 2 shows various simulated frequencies which may cause registration errors in a printing press and the simulated registration errors with and without the present invention.

A computer study was performed to illustrate the implementation of the minimum time response commands. In FIG. 2 the measured print-to-cut error was simulated by the summation of four frequency signals. F1 is at the time response period of the machine. F2 is a significantly higher frequency. F3 and F4 are significantly lower frequencies. All of these frequencies simulate possible registration errors faced by the folder. The sum of these frequencies $F_N$ shown is the predicted print-to-cut registration error without any corrective measures. The bottom delivered product line shows the predicted print-to-cut registration error with the present invention. As can be seen, many of the errors are reduced or eliminated.

FIG. 3 illustrates the optimum move commands to the drive motor controller 4, based on the position command data stream, the speed command data stream and torque command data stream. FIG. 3 also shows the resulting delivered product that is predicted in relation to the previous error. Low frequency errors are eliminated. Frequencies near the response bandwidth are attenuated. High frequency errors, however, remain.

What is claimed is:

1. A method for maintaining the register of images on a running web with a web processing device of the machine comprising the steps of:

measuring a position of each image on the web;

generating a reference signal corresponding to a desired position of each image on the web;

creating a registration error data stream corresponding to the difference between the measured image positions and the reference signals;

continuously sending control commands to the web processing device based on at least the registration error data stream;

creating a speed command data stream by calculating changes in the registration error data stream and sending control commands to the web processing device based on the speed command data stream; and creating a torque command data stream by calculating changes in the speed command data stream and sending control commands to the web processing device based on the torque command data stream.

2. The method as recited in claim 1 wherein the measuring of the position of the images of the web is performed in sample sets.

3. The method as recited in claim 1 wherein the web processing device is a cutting cylinder.

4. A method for maintaining the register of images on a running web with a web processing device of the machine comprising the steps of:

measuring a position of each image on the web;

generating reference signal corresponding to a desired position of each image on the web;

creating a registration error data stream corresponding to the difference between the measured image positions and the reference signals;

continuously sending control commands to the web processing device based on at least the registration error data stream; and creating a torque command data stream by calculating the second derivative of the registration error data stream and sending control commands to the web processing device based on the torque command data stream.

5.The method as recited in claim 1 wherein the measuring of the position of the images of the web is performed in sample sets.

6. The method as recited in claim 5 wherein the number of images in a sample set is determined based on the minimum response time of the web processing device.

7. The method as recited in claim 1 wherein the web processing device is a cutting cylinder.

8. A method for maintaining the register of images on a running web with a web processing device of the machine comprising the steps of:

measuring a position of each image on the web;

generating a reference signal corresponding to a desired position of each image on the web;

creating a registration error data stream corresponding to the difference between the measured image positions and the reference signals;

creating a torque command data stream by calculating the second derivative of the registration error data stream; and sending control commands to the web processing device, the control commands at least being based on the torque command data stream.

9. The method as recited in claim 8 wherein the measuring of the position of the images of the web is performed in sample sets.

10. The method as recited in claim 8 wherein the web processing device is a cutting cylinder.

11. The method as recited in claim 8 wherein the control commands are at least based directly on the registration error data stream.

12. The method as recited in claim 8 further comprising the step of creating a speed command data stream by calculating changes in the registration error data stream, wherein the control commands are at least based directly on the speed command data stream.

* * * * *